US005427445A

United States Patent [19]

Mitchell

[11] Patent Number: 5,427,445

[45] Date of Patent: Jun. 27, 1995

[54] DRAWER INTERLOCK STRUCTURE

[75] Inventor: Terry L. Mitchell, Jenison, Mich.

[73] Assignee: Quest Engineering, Ada, Mich.

[21] Appl. No.: 318,246

[22] Filed: Oct. 5, 1994

[51] Int. Cl.[6] ..... E05C 7/06

[52] U.S. Cl. ..... 312/221; 312/215; 312/216; 312/217; 312/218; 312/219; 312/220; 30/218; 30/219; 30/220

[58] Field of Search ..... 312/215, 216, 217, 218, 312/219, 220, 221, 222, 295

[56] References Cited

U.S. PATENT DOCUMENTS

| | | | |
|---|---|---|---|
| 3,799,638 | 3/1974 | Faiks | 312/216 |
| 3,941,441 | 3/1976 | Scheerhorn | 312/215 |
| 4,061,371 | 12/1977 | Prather et al. | 312/222 X |
| 4,092,056 | 5/1978 | Signore et al. | 312/218 X |
| 4,469,382 | 9/1984 | Slaats et al. | 312/219 |
| 4,609,233 | 9/1986 | Walla | 312/215 X |
| 4,768,844 | 9/1988 | Ludwig | 312/221 |
| 4,770,476 | 9/1988 | Lakso | 312/221 X |
| 4,889,396 | 12/1989 | Mitchell | 312/221 |
| 4,957,334 | 9/1990 | Lakso | 312/219 X |
| 4,966,423 | 10/1990 | Higuera et al. | 312/216 |
| 5,056,877 | 10/1991 | Westwinkel | 312/217 X |
| 5,074,627 | 12/1991 | Broeders | 312/218 X |
| 5,176,436 | 1/1993 | Mitchell | 312/221 |
| 5,199,774 | 4/1993 | Hedinger et al. | 312/219 |

*Primary Examiner*—Kenneth J. Dorner

*Assistant Examiner*—Rodney B. White

*Attorney, Agent, or Firm*—Miller, Morriss & Pappas

[57] ABSTRACT

An interlock structure of the cable type for stacked plural drawer cabinet structures which limits the opening of drawers to a single drawer and prevents plural drawers being opened at the same time. An elongate base or frame is mounted in the cabinet adjacent to the drawers. The frame supports plural (one for each drawer) eccentric blocker elements and adjacent follower elements and supports at one end a provided slider element having limited movement. A cable is attached at one end to the slider and at the other end to the frame with an intermediate loop which provide two cable courses, one of said courses threaded on the successive blockers and the other course operably threaded over the respective adjacent followers maintaining the respective blockers and followers in operative engagement. The blockers are moved by interference engagement by a selected drawer. The opening of one drawer causes movement of the respective blocker and movement of the respective follower to an over-center prevent position so that, upon attempted opening of plural drawers or of a second drawer, the blockage is made firm and the slider engages its limit in prevention of any such movement until all drawers are closed. Locking is by plunger means in prevention of any slider movement by simultaneously engaging the slider with the frame.

8 Claims, 3 Drawing Sheets

DRAWER INTERLOCK STRUCTURE

FIELD OF THE INVENTION

The present invention relates to a new and useful structure applicable to stacked drawer devices as found in plural drawer banks such as in vertical storage cabinetry, filing cabinets, office furniture, and the like. The weight of each drawer and its contents makes it desireable to provide simple, inexpensive, and reliable means for assuring that only one drawer in the stack is openable at any single time in prevention of overturning the entire vertical column of drawers. The entire column of drawers should be easily and selectively locked for security reasons, and in the present structure the security locking is achievable by simple means of a barrier (achievable by electronic controlled solenoid or simple mechanical push-pull means capable of remote actuation. The present invention achieves all of these objectives in a new and useful interlock structure via a tensioned cable-like apparatus of extreme simplicity which is economical to manufacture and install and where a cushioned slider element limits the movement of the cable-like element upon a single withdrawal movement of any drawer in prevention of any additional drawer movement in the tiered or stacked column of drawers until return closure of the withdrawn drawer. The present new and useful invention accommodates variant drawer heights and lengths in the same stack with minimal added weight of apparatus and with quietness of function. The present invention requires no modification of existing drawer glides and drawers and requires minimal clearance within the drawer cabinets in flank relation to one or the other of the drawer column sides.

DESCRIPTION OF RELATED ART

Interlocks for stacked drawers are known and are best exemplified in U.S. Pat. Nos.: 3,799,638 of Faiks; 3,941,441 to Sheerhorn; 3,966,423 to Higuera et al; and 4,889,396 and 5,176,436 to Mitchell. Industrial exploitation of these devices has been limited because of cost factors, inability to adjust to variations in drawer heights in a given stack, noise factors, problems of installation and failure to provide convenient locking and spacing. The present invention extends beyond the prior art directions by providing simplified structure, economy in production and installation, and simplicity and flexibility in accommodation of lock means, especially as regards amenability to remote actuation.

By contrast, the presently claimed invention also utilizes a cable, strap, or other resilient energy storing element. The cable element is secured at one end to a slider element and the other end of the cable element is secured to the base or frame adjacent to the slider element. The cable element is, at all times, under a slight tension by reason of substantially traversing the length of the base or frame and over a motion translating sheave or pulley. Intermediate the extremities of the base or frame is a plurality of eccentric blockers, each blocker having selected paths or surfaces over which the cable element travels. The blockers each include guide surfaces, which are engaged with a follower element actuated upon the opening of any selected one of the drawers. Movement of the slider and the follower occurs upon the withdrawal of any one of the drawers, each drawer having a laterally extending actuating pin which moves with the drawer and the pin causing the rotation of the blocker element and the movement of the blocker also results in a tensioning of the cable and rotation and consequent displacement of the follower. The follower element itself is kept from returning to its relaxed position by a tension in the cable brought about by the drawer displacement of the follower and the blocked over-center positioning of the follower in relation to the differentially eccentric blocker surfaces. The movement of the follower by the drawer displaces the cable element thereby displacing the slider in its relative vertical and limited movement. In this position of the follower element, no further movement of the cable is possible so long as the drawer remains open and the corresponding blocker element is in its eccentric and over-center position. Each of the blockers serving each of the drawers is also restricted from movement because of the tautness in the cable resulting from the limited extension of the slider. Thus all drawers except the first opened are prevented from withdrawal. When the first withdrawn drawer is closed, the pin extending laterally from the side of the closing drawer pockets in the blocker element reversing movement of the follower element and releasing the blocking action of the surfaces of the blocker. The spring bias tension against the slider restores a minimal tensioned position of the cable against all of the plural blockers in the drawer stack. Thus the blockers and their respective followers are armed for selected single drawer withdrawal with attendant restriction in prevention of opening movement in the other of the drawers. In facilitation of locking the entire vertical column from any withdrawal, as for security reasons, the simple thrust of an activating pin to block the slider against the base or frame provides a simple effective and inexpensive lock. Thus the present invention makes possible remote control over locking by the use of solenoids or activating plungers blocking the slider from any movement in relation to the frame and security-locking the entire drawer stack.

The blocker elements are eccentrically pivotal in the selected drawer intervals (spaced in accord with the size of each of the drawers in the stack). The blockers are one piece unitary elements precision cast and shaped to match and receive the respective drawer actuating pins and assisted by the tension cable to move the follower element to an over-center blocking location preventing other drawers from being opened until the selected single opened drawer is closed.

The base or frame is preferred in an elongate channel form easily mounted as by welding or otherwise fastening to the inside panels or frame of the drawer encasement structure. The base or frame is easily located and pre-planned for assembly of slider, blockers, followers, and the pulley with the cable assembly.

The progress implications of the present structure will be readily recognizable to those familiar with the requirements and installational limits permitted in furniture such as filing cabinets, desk drawer pedestal stacks, and the like, as the description proceeds.

DESCRIPTION OF THE PREFERRED EMBODIMENT

Figure 1:
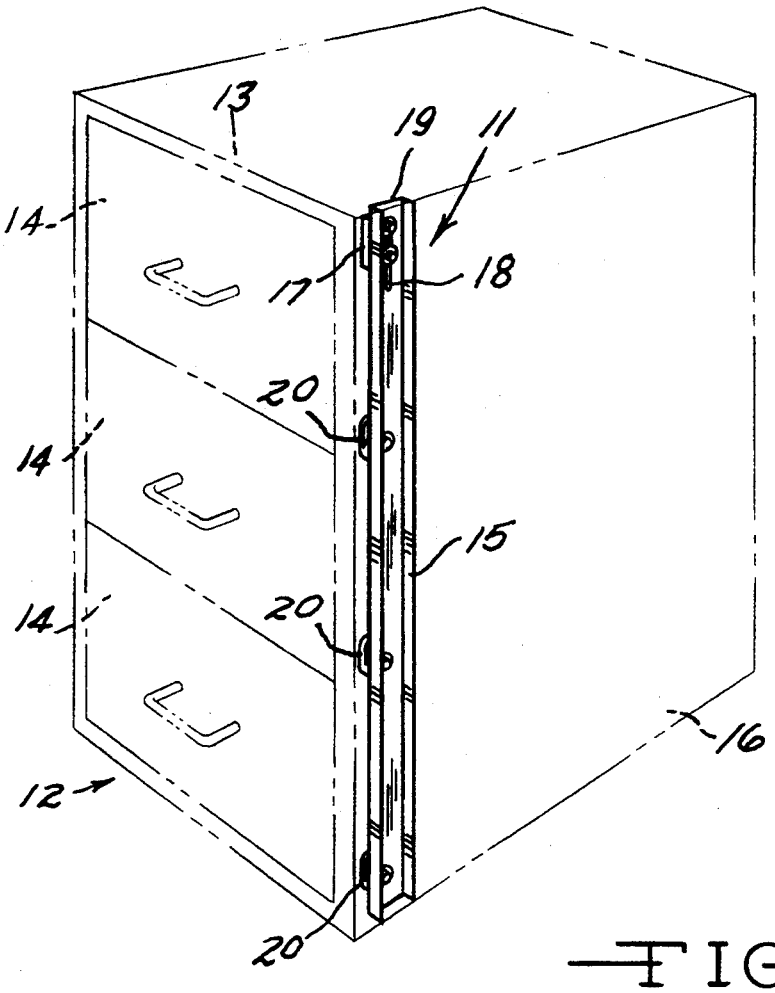
FIG. 1 is a perspective view in partial phantom-line of a typical plural drawer stack of drawers into which (in full line) the locking and interlocking structure of the present invention (illustrating the vertical elongated base or frame secured to the cabinet and the blockers) is shown in registering position flanking each of the drawers.

Referring to the drawings, the FIG. 1 locates the interlock structure 11 of the present invention on a typical installation in a cabinet 12 having a plurality of stacked drawers 13 and all individual drawers 14 in the stack shown in the closed position within the cabinet 12. The drawers 14 flank the interlock structure 11 which is attached to the inner wall of the cabinet 12 in a registry better understood as the description proceeds. The interlock structure 11 comprises an elongate channel-like base or frame 15 which is shown secured to the inside of side wall 16 of cabinet 12 as by welding or other conventional fastening means of attachment. A slider or slider plate 17 is secured to the web of the frame 15 and is guidably slidable for limited movement in the slot 18 adjacent the upper end 19 of the vertically oriented base or frame 15. As will be subsequently appreciated the slider 17 is under a spring bias toward the upper end 19 of the slot 18. The interval of the drawers 14 in drawer guides (not shown) and the registering interval in the interlock structure 11 is established by the location of the blocker elements 20 in interference with trip pins extending from each of the drawers 14 as will be better appreciated as the description proceeds. Accordingly, as a drawer 14 is opened the trip pin on the drawer 14 engages the blockers 20 causing the interlock 11 to function in locking all other drawers 14 until the opened drawer 14 is closed and the selected blocker 20 serving the opened drawer 14 then joining the closed stack of drawers 13 as shown. Any attempt at simultaneous opening of drawers 14 exceeds the limits of the slider 17 and prevents any such opening.

Figure 2:
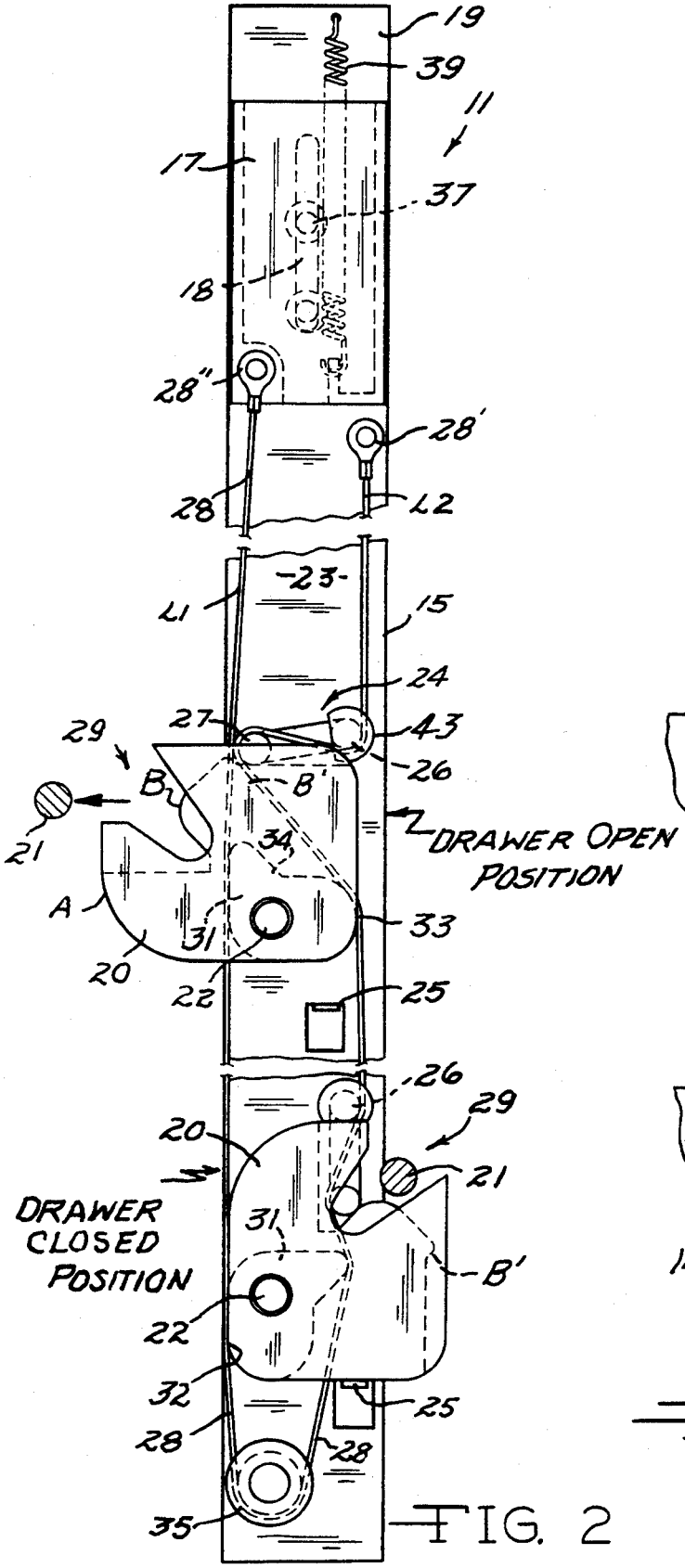
FIG. 2 is a side elevation view of the locking and interlock structure shown in FIG. 1 from the drawer-interface side and indicating an application of the present structure to a plural drawer (two drawer stack) and relating the eccentric movement of one of the blockers at the opening of one of the drawers. Also illustrated is the cable relationship to the blockers and to the respective followers when a single drawer is opened and other drawers in the plural drawer stack are blocked against opening until the first opened drawer is closed. The threading of the cables are revealed in respect to the blocker and follower surfaces as those surfaces are re-oriented upon opening and closing of a single drawer. Relaxation of the tension on the cable causes the slider element to restore a resilient slackness in the cable.

In FIG. 2 a plural drawer stack 13 (two drawers shown) and the function of interlock structure 11 is best understood in respect to the trip pins 21 which extend from the sides of all of the drawers 14 and which trip pins 21 activate and deactivate the function of interlock 11 in permitting only a single drawer 14 to be opened and which thereupon places other drawers 14 in the stack of drawers 13 (FIG. 1) in a locked relation against withdrawal until such time as the opened drawer 14 is closed into the stack 13. The blocker elements 20 serving each drawer 14 are shown pivotal upon the posts 22 in aligned vertical relation through the web portion 23 of the channel base 15. The follower elements 24 depend from pivots 26 and provide a pivotal interference with eccentric engagement surfaces A, B, and B′ of the respective blockers 20. The blockers 20 each include a blocker surface B against which the followers 24 thrust. Rest stops 25 are provided through the web 23 and establish a rest position for the blockers 20 as indicated in the lowermost of the blockers 20. The followers 24 thus rotate at the posts 26. The throw arm 27 of each of the followers 24 thrusts against the surface B of the blocker elements 20 in controlled movement of the throw arm 27 to an over-center or prevent lock against tension applied to the cable 28 (as shown in the uppermost blocker 20) in which the trip pin 21 indicates an opened drawer 14. Pockets 29 through the outer perimeter surface of the blockers 20, as shown, trap the trip pins 21 in their opening travel with their respective drawer 14 thereby causing rotation and release of the rotation of the blocker 20 (shown at the uppermost blocker 20) while posturing the blocker 20 to receive a return of the drawer 14 and reversal of the rotation of blocker 20 to a position against the respective rest stop 25 as indicated in the lowermost of the illustrated blockers 20 in the FIG. 2. The change of contour 30 at the step surface B′ defines the over-center holding position noted upon the withdrawal of the trip pin 21 with its respective drawer 14. In addition, as shown in the uppermost withdrawal of trip pin 21, the blocker 20 asserts a barrier surface 31 buttressing the cable 28. The blocker 20 in the lowermost closed drawer situation is seen as presenting a similar guide buttressing of the cable 28 at surface 32.

The cable 28 is attached by fastener 28′ firmly to the base or frame 15 at one end and after extending downwardly and tortuously over and under the pivot posts 26 and around the throw arm 27 of the follower element 24 it passes over the stepped and contoured guide portion 33 of the blockers 20 in open drawer position. This creates a loop L and divides the cable 28 into two courses, L1 and L2. The cable 28 traverses to repeat the course through all of the vertically aligned blockers 20, and where such blockers 20 are in closed drawer position (lowermost blocker 20 as shown) the cable 28 has drawn the throw arm 27 into compression engagement against the stepped surface B of the closed drawer position of blocker 20 and thence travels tortuously downward as shown over the nose portion 34 thereof and thence downward and over the roller or pulley 35 located as shown beneath the lowermost of all of the blocker elements 20 and the cable 28 runs generally parallel to the plane of the channel or base 15 with a return upwardly to connection as shown with the slider 17 by means of fastener 28" and in guided vertical travel against the surfaces of the blockers 20 as presented by barrier surfaces 31 and 32 generally paralleling the vertical edges of the base 15.

The slider 17 is guided in FIG. 2 and controlled by reference to the base or frame 15 as by means of the slot 36 in the web portion 23 adjacent the upper end of the base 15 as shown in cooperation with the central guide post 37 of the slider 17 and a spaced apart blocking post 38 and in the vertical slot 36 substantially at full travel of the slider 17. The guided motion of the slider 17 is vertical and alignment with the frame 15 is maintained while the slider 17 is travelling and the spring 39 under tension between the upper end of the frame 15 and the spring's attachment to the slider 17, as shown, provides a constant bias in the cable 28. In the FIG. 2 the uppermost drawer 14 has been opened and the other of the plural drawers 14 are locked against removal since no further extension of the cable 28 is possible and the slider 17 is bottomed at post 38 in the slot 36 as shown.

Figure 3:
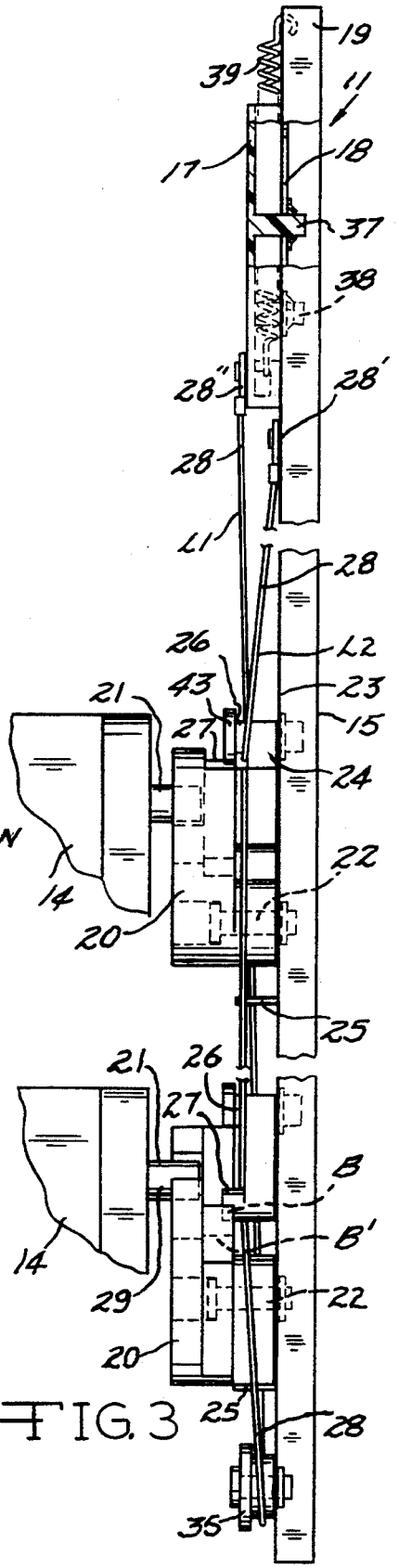
FIG. 3 is an end elevation view of the FIG. 2 in which the simple slider construction riding on the vertical track of the frame provides a constant bias and tension through limited travel in the cable and shows how the eccentric function of the blockers act to permit only a single drawer opening and the interlock of other of the drawers upon the single drawer opening. The limited movement permitted by the downward movement of the slider as shown is sufficient to prevent opening movement of other drawers and prevents any attempt to simultaneously open plural of the drawers.

The FIG. 3 indicates the situation as shown in the FIG. 2 and indicates graphically the relationship of the drawers 14 and their extending trip pins 21 by means of which the blockers 20 relate to the cable 28, to the over center function of the respective followers 24 and to the limiting function controlled by the slider 17.

Figure 4:
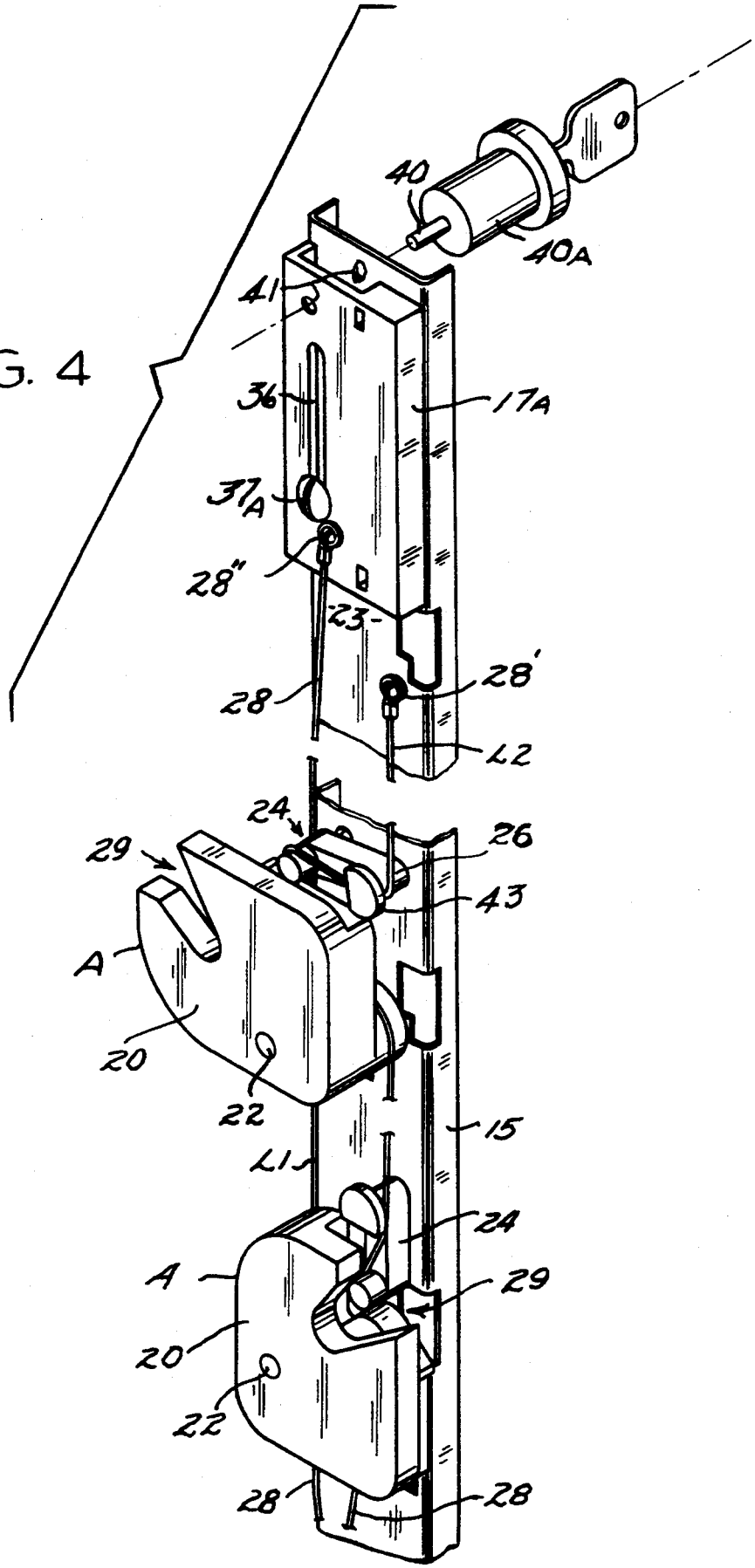
FIG. 4 is a perspective view of the structure illustrated in the FIGS. 2 and 3 and best demonstrating the compactness of the present inventive structure and facility for providing clearance for guide structure for the drawers without crowding or loss of cabinet space. In addition the FIG. 4 illustrates the plunger security lock which can be selectively adapted to remote control as by solenoids mimicking the push-pull of the lock pin of the lock element (key type), as shown. A somewhat modified slider is illustrated. The FIG. 4 has been cut away but the pulley for the cable remains as in the FIGS. 2 and 3.

Referring to FIG. 4, the base or frame 15 and plural blockers 20, followers 24 and the rigging of the cable 28 connected at one end to the slider 17A and connected at the other end firmly affixed to the frame 15 are functionally as in the FIGS. 1, 2, and 3. Variance, however is expressed in the form of the slider 17A in which a single guide post 37A is fastened to the frame 15 through the elongated guide slot 36A provided through the uppermost surface of the slider 17A as shown and the uppermost end of the cable 28 is secured to the slider 17A. The motion of the slider 17A is limited by the length of the slot 36. The spring tension is provided by spring means (not visible) and is concealed within the slider 17A providing an ever present slider bias on the slider 17A toward the upper end of the frame 15 as shown. This variant also best illustrates the use of a plunger type lock which is illustrated with a key type barrel 40A which permits the locking of the entire stack of drawers by moving the plunger or piston into axially aligned receiver openings 41 through the frame 15 and the slider 17A. The importance of this capability is to provide a unique security lock easily and economically operated by a variety of remote means via electrical and electronic controls by reason of the plunger-like motion and simple actuation. In other respects the interlock function of the structure of FIG. 4 is substantially identical to the description respecting FIGS. 1, 2, and 3. The pulley 35 has been omitted in the FIG. 4 but is, in fact, as shown in FIGS. 2 and 3.

Figure 5:
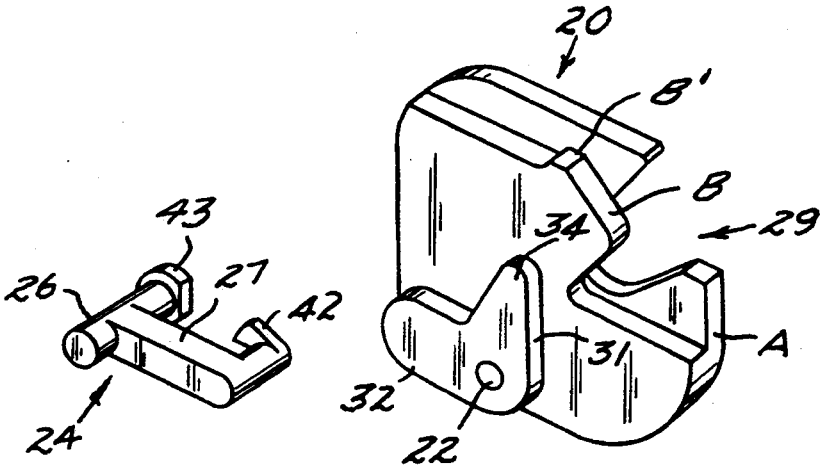
FIG. 5 is a perspective exploded view of the integrally provided blocker element and the cooperating follower and illustrating the plural surfaced blocker in relation to the follower controlled by the combination of cable tension which provides the over-center blockage. The slot pocketing and accepting of the activation means such as by a trip pin carried by the drawer in interference location for selective release of the cable lock and then permitting the counter rotation by the blocker and the pick-up of excess cable assisted by spring means of the slider mechanism as shown.

By reference to FIG. 5 the interrelationship of the blockers 20 to their respective followers 24 in their achievement of an over-center blocking against the cable when withdrawal of a drawer 14 occurs is best appreciated. The blocker 20 and its follower 24 was journalled on the frame or base 15 and they are rigged in respect to the cable 28 as best seen in FIGS. 2, 3, and 4. In the FIG. 5 the surfaces A, B and B' as well as the surface 31 are better revealed in the unitary precision casting 28 in relationship to their eccentricity from the pivot axis at the post 22. This considerably clarifies the movement of the follower 24 on its separate pivot post 26 which is also pivotal on the frame 15. The flanging 42 of the follower element 24 on the arm 27 assists in orientation of the resilient energy storing element shown as cable 28 as the blocker 20 is rotated upon opening of the corresponding drawer 14 as the trip pin 21 (FIGS. 2 and 3) rotates the blocker 20 on its pivot 22 (closed lowermost drawer 20) to the open drawer condition in the uppermost of the illustrated drawers). At the open position the arm 27 climbs the surface B with the captured cable 28 where it retains an over-center grip on the cable 28 and detentably held by the bump at surface B' and displaces only upon closing of the respective drawer. The dual function of the step portion 32 as a guide surface for cable 28 and surface 31 as guide in the open drawer condition are better understood as their displacement shows. The surface A maintains a control over the pivot post 26 and the flange 43 orients the flow of the cable 28 under tension and at release.

OPERATION

The economy of the interlock of the present invention is apparent in the simplicity and reproducibility of the principal elements. The sliders 17 are preferably cast as unitary elements as are the blockers 20 and followers 24 using plastic or resin materials having high strength and good wear characteristics against cables 28 and the cables 28 may be resin jacketed as required. Snap assembly fasteners as illustrated provide excellent strength and security and are used in combination with the base 17 in resin or in metal provide a combination which is quiet and durable. Finally, the clearances required in saving of cabinet space is well served in the claimed structure as shown and installation and service is simple as can be seen. Simplicity of assembly is obvious as is also adjusting amenably to various drawer spacing and types as encountered in business and household furnishings where stacked drawer cabinetry is predominently found. In operation the units are quiet and durable. Positive plunger security locking of an entire stack of drawers is made available within the interlock 11.

Having thus described my new and unobvious interlock and its performance, others skilled in the art will perceive modifications and improvements and such modification and improvements are intended to be included within the spirit of the present invention limited only by the scope of the appended claims.

I claim:

1. A limited travel energy storing interlock for stacked plural drawers comprising:

a vertical elongate frame attachable in stacked plural drawer cabinets adjacent said drawers;

a plurality of substantially identical blocker elements, each having differential transition eccentric blocker surfaces, each said blocker supported in vertical alignment on said frame, and each of said blocker elements in interference registry with a corresponding one of said plural drawers;

a spring loaded slider vertically guided and limitedly movably secured to one end of said frame;

energy storing means secured at one end to said frame and at the other end to said slider, said energy storing means having a loop portion intermediate the ends thereof;

a pulley attached to said frame at the end of said frame opposite said slider and over which said energy storing means defines two courses;

followers pivotal on said frame, one adjacent each blocker and provided with movable contact portions against said blockers, said followers activated by one course of said energy storing means which under tension urges contact with said blockers and said other of said courses of said energy storing means in compression contact with eccentric of said surfaces of said blockers;

detent means provided on the transition eccentric surface of said blocker locking said follower into over-center compression contact against said blocker upon opening any one of said drawers in prevention of any other of said drawers being opened.

2. A limited travel energy storing interlock for stacked plural drawers as recited in claim 1, wherein opening movement of any other of said drawers in drawers is prevented by said spring loaded slider blocked against said frame barring any attempted opening of another of said drawers.

3. A limited travel energy storing interlock for stacked plural drawers as recited in claim 1, wherein the simultaneous opening movement of plural of said drawers results in said slider engaging said frame and blocking the opening of all of said drawers.

4. A limited travel energy storing interlock for stacked plural drawers as recited in claim 1, and including lock means in prevention of any opening of said drawers, said lock means comprising a plunger pin passing through a mating opening in said frame and with a mating opening in said slider in prevention of motion of said slider.

5. A limited travel energy storing interlock for stacked plural drawers as recited in claim 4, wherein said plunger action of said pin is remotely and reciprocally actuated.

6. A cable type interlock for stacked plural drawers comprising:

an elongate frame for attachment within said cabinets adjacent said stacked plural drawers;

a plurality of blockers each having plural eccentric surfaces openably supported upon said frame, each said blocker in interference register with a corresponding one of said drawers;

a spring loaded slider operably secured to said frame at one end of said frame and guideably and limitedly movable on said frame;

a cable connected at one end to said spring loaded slider and at the other end to said frame creating an intermediate loop of said cable in two courses one of said courses acting against said blockers;

followers pivotal on said frame, one said follower adjacent each said blocker and in following engagement with said blocker movement whereby upon opening of one of said drawers said respective follower is detentably blocked and tautly tensioned by said other of said cable courses to an over-center position until said open drawer is closed and said blocker disengages said follower from said over-center detent position and relaxes tensioning of said cable.

7. A cable operated interlock for stacked plural drawers comprising:

an elongate frame positionable inside said cabinets and adjacent said drawers;

blockers having differentially eccentric surfaces pivotally mounted on said frame one adjacent to each drawer and in interference relation with each opening and closing of each drawer;

follower elements mounted on each frame and rotatable on said frame to following engagement with respect to said blockers;

a slider element at one end of said frame having limited movement and under a spring bias acting between said frame and said slider;

a cable connected to said frame at one end and connected to said slider at said other end and forming a loop of said cable between said cable ends;

a pulley over which said loop of said cable passes defining two connected courses; one of said courses attached to said frame and operably engaged with said blockers and the other of said courses passing through said blockers and around and over said followers to connection with said slider, whereupon displacement of any one of said blockers, upon opening any one of said drawers, tensions said cable against the bias of said slider and moves said slider adjacent to its limit and upon attempt to open any other of said drawers said slider reaches the limit until closure of said opened drawer.

8. A cable operated interlock for stacked plural drawer cabinets as recited in claim 7, and including lock means for all drawers against opening of any of said drawers including a remotely operable plunger lock through an aligned opening registrably defined in said frame and in said slider.

* * * * *